United States Patent [19]

Bills et al.

[11] 4,307,323

[45] Dec. 22, 1981

[54] VACUUM GAUGE

[75] Inventors: Daniel G. Bills; Paul C. Arnold, both of Boulder, Colo.

[73] Assignee: Granville-Phillips Company, Boulder, Colo.

[21] Appl. No.: 137,461

[22] Filed: Apr. 4, 1980

[51] Int. Cl.[3] ..... H05B 31/26

[52] U.S. Cl. ..... 315/111.91; 313/7; 324/462

[58] Field of Search ..... 315/111.9; 324/462, 324/464, 470; 250/489; 313/7

[56] References Cited

U.S. PATENT DOCUMENTS

| | | | |
|---|---|---|---|
| 3,243,649 | 3/1966 | Kreisman | 315/111.9 |
| 3,394,286 | 7/1968 | Brock | 315/111.9 |
| 3,465,189 | 9/1969 | Redhead | 313/7 |
| 3,466,484 | 9/1969 | Clay, Jr. et al. | 313/7 |
| 3,742,343 | 6/1973 | Pittaway | 324/462 |
| 3,906,237 | 9/1975 | Pittaway | 250/489 |

*Primary Examiner*—Eugene R. La Roche

*Attorney, Agent, or Firm*—Cushman, Darby & Cushman

[57] ABSTRACT

A hot filament ionization gauge is provided with a very small diameter and/or very short collector to limit interception of X-ray flux. Suitable gauge sensitivity is achieved by additionally collecting ions at the collector support, which is shielded from the X-ray flux by a shield. Collection of ions by the shield is avoided by maintaining the shield at grid potential.

17 Claims, 4 Drawing Figures

VACUUM GAUGE

BACKGROUND OF THE INVENTION

This invention relates to vacuum gauges and more particularly to ionization gauges for use in the ultra-high vacuum range.

In known ionization gauges, the number of positive ions formed within the gauge, in a gas susceptible to ionization by election impact, is directly proportional to the molecular concentration of the gas. Known ionization gauges typically comprise a source of electrons (cathode), an accelerating electrode (anode) to maintain electron current, and a collecting electrode (collector) to collect the ions formed by electron impact in the gas. While ion formation is not believed theoretically to have a low pressure limitation, one of the more serious practical barriers to useful ultra-high vacuum measurement is the production of undesirable extraneous currents in the gauge which are independent of gas pressure.

The undesirable extraneous currents principally result from the so-called X-ray effect. Bombardment of the anode by electrons produces soft X-rays. The soft X-rays impinge the collector, thereby producing a photo-electron current which adds to the ion current in the collector. As photo-electron current and the ion current are not distinguishable from one another, the photo-electron current establishes a lowest practical limit beyond which meaningful ion current measurement cannot be had.

One known type of ionization gauge incorporates a fine wire as the collector. The anode is a grid-like structure. Such an apparatus is disclosed in U.S. Pat. No. 2,605,431, issued July 29, 1952 to Bayard. Known ionization gauges incorporating thin wire collectors are suitable for measuring pressures as low as $3\times10^{-10}$ Torr with an open ended grid volume, and $2\times10^{-11}$ Torr with a close ended grid volume. Measurements of even lower pressures is desirable, however.

It is known to reduce the diameter of a collector to less than approximately 0.002 inches for decreasing interception of the X-ray flux. Because the ion current decreases approximately proportionally, however, the lowest measurable pressure limit of an ionization gauge cannot be extended by merely reducing collector diameter.

It is known to achieve ultra-high vacuum measurements with extremely small diameter ion collectors of approximately 4 microns (0.00016 inches) by applying an unusually high ion collection voltage between the anode and collector. Such an apparatus is disclosed in U.S. Pat. No. 3,253,183, issued May 24, 1966 to Van Oostrom. Although the X-ray flux impinging the collector is reduced, the disadvantages include the need for an abnormally high ion collection voltage and supporting structures for both ends of the collector.

It is also known to reduce the X-ray flux impinging the collector by shortening the collector length. The disadvantage experienced in the art by such an approach, however, is to seriously decrease the percentage of positive ions collected.

It is also known to completely withdraw the ion collector from the grid volume in which positive ions are formed. Ion extraction may depend on field penetration, as in U.S. Pat. No. 3,463,956, issued Aug. 26, 1969 to Groszkowski. Alternatively ion extraction may depend on the application of a separate accelerating voltage to one or more additional electrodes. An example of a device based on the latter principle is found in U.S. Pat. No. 3,465,189, issued Sept. 2, 1969 to Redhead. The disadvantage of such prior art ion extractor gauges is the need for a separate accelerating voltage and one or more additional electrodes if a reasonable gauge sensitivity is to be achieved. The inclusion of an accelerating voltage and additional electrode, however, increases the complexity of construction and difficulty of use.

SUMMARY OF THE INVENTION

The present invention provides an improved hot filament ionization gauge suitable for ultra-high vacuum measurement. The present invention utilizes a very small diameter and/or very short collector to limit interception of X-ray flux. Suitable gauge sensitivity is achieved by additionally collecting ions at the collector support, which is shielded from the X-ray flux by a shield maintained at grid potential. The present invention is compatible with existing standard ionization gauge power supplies, requiring no additonal feed thrus, leads, or voltage sources.

BRIEF DESCRIPTION OF THE DRAWINGS

In the figures, where like numbers indicate like parts.

DETAILED DESCRIPTION OF THE INVENTION

Figure 1:
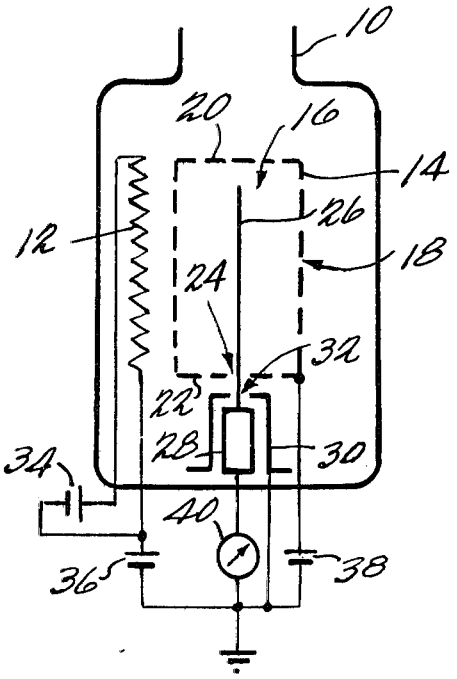
FIG. 1 (PRIOR ART)
FIG. 1 is a schematic diagram of a typical prior art gauge.

A typical prior art vacuum gauge tube is shown in FIG. 1. The gauge assembly is contained within a cylindrical envelope 10, typically formed of glass having a tin-oxide coating or other suitable enclosure material. Alternatively the gauge assembly may be a nude gauge (a gauge having no envelope and otherwise suitable for insertion into the vacuum system), suitable containment means being provided in the vacuum system as is well known in the art. The cathode 12 is a thermionic electron emitter suitably formed of a hairpin or straight coiled filament. The anode, hereinafter referred to as a grid 14, is suitably formed of helical or transverse wires. Grid 14 is suitably biased to accelerate electrons emitted from the filament 12 such that an electron entering grid volume 16 has a desired kinetic energy corresponding to, for example, the maximum ionization probability of the molecules of the gas undergoing vacuum measurement. The grid 14 is provided with openings 18 whereby a suitable electron transparency is obtained. The grid 14 also has end cap portions 20 and 22. The end cap portion 22 has an opening 24 therein through which a collector 26 passes. The collector 26 is suitably thin wire, typically having a diameter greater than 0.002 inches. The collector 26 is supported by a collector support 28. A collector shield 30 reduces the X-ray flux incident to the collector support 28, and is suitably provided with an opening 32 through which the collector 26 passes. The collector 26 is substantially coaxial with the axis of the grid 14 and extends through approximately the entire grid volume 16. The cathode 12 is heated by voltage source 34, and maintained at a predetermined potential above ground by voltage source 36. The grid 14 is maintained a predetermined potential above ground by voltage source 38. Typical values for the electrode potentials required for operating the prior art ionization vacuum gauge are as follows: collector potential, zero (ground); grid potential, 180 volts (source 38); cathode filament potential, 30 volts (source 36); and envelope, zero (ground). An ion current meter 40 connects the collector 26 and the collector support 28 to ground for measuring the ion current.

The prior art ionization gauge strictly measures the density of a gas within the grid volume 16. Electrons emitted by the cathode 12 are accelerated into the grid volume 16 by the cathode-grid potential. The ions formed by electron impact in the gas are collected by the collector 26, and the resulting ion current is measured by the ion current meter 40.

Electrons accelerated into the grid volume 16 often pass through the grid region several times before they bombard the positive grid 14. In impinging on the grid 14, however, soft X-rays are produced which in turn impinge on the collector 26 to produce photo-electrons. The relatively large collector support 28 is shielded from the effect of the soft X-rays by a collector shield 30. Such shields typically may comprise metal or metal-coated glass that is maintained at ground potential, as disclosed in U.S. Pat. No. 3,071,704, issued Jan. 1, 1963 to Reich. Such shields also typically may comprise a glass tube that is allowed to float, in which case the insulated surfaces acquire a negative charge because of the preponderance of energetic electrons present in the gauge in normal operation. An example of a floating collector shield is provided in U.S. Pat. No. 3,350,590, issued Oct. 31, 1967 to Young.

The present invention recognizes that under certain circumstances, some positive ions formed within the grid volume 16 escape through the opening 24 rather than being collected by collector 26. The ions formed in the grid volume 16 do not have sufficient energy to escape through openings 18. While opening 24 and openings 18 are similar, the ions nonetheless do have sufficient energy to escape through opening 24 because of the positioning of collector 26 within. In prior art gauges having closed end caps, such as end portions 20 and 22, the diameter of the opening 24 is typically not less than about 0.30 inches. When the diameter of collector 26 is made smaller than approximately 0.002 inches, many ions have sufficient angular momentum to miss collector 26 on the first pass. These ions drift axially and, when their axial and radial positions are correct, pass through the opening 24 and escape.

In such prior art gauges, positive ions escaping through the opening 24 encounter the collector shield 30, which typically is a grounded metal tube or the negatively charged glass collector shield, as aforementioned. The grounded or negative collector shield 30 collects escaping positive ions, which are thereby made unavailable to the ion current meter 40. Furthermore, in prior art designs, the use of very thin wire collectors to decrease the amount of X-ray flux intercepted (less than 0.002 inches) results in the loss of a large fraction of the available ions formed within the grid volume 16.

The present invention also recognizes that the use of a shortened collector that only partially penetrates the grid volume 16 produces an axially downward accelerating field for positive ions formed above the shortened collector in the grid volume 16. The axially downward accelerating field causes these ions to escape through the opening 24, again to be collected by the collector shield 30 if, as in the prior art, it is grounded or left floating.

Although few ions will escape if the diameter of the opening 24 is decreased beyond 0.30 inches, the present invention also recognizes that substantially all of the ions escaping through the opening 24 can be collected by a shortened and very thin collector and the collector support 28 when the collector shield 30 is electrically connected to the grid 14 rather than connected to ground or left floating. Accordingly, suitable gauge sensitivity can be maintained.

Figure 2:
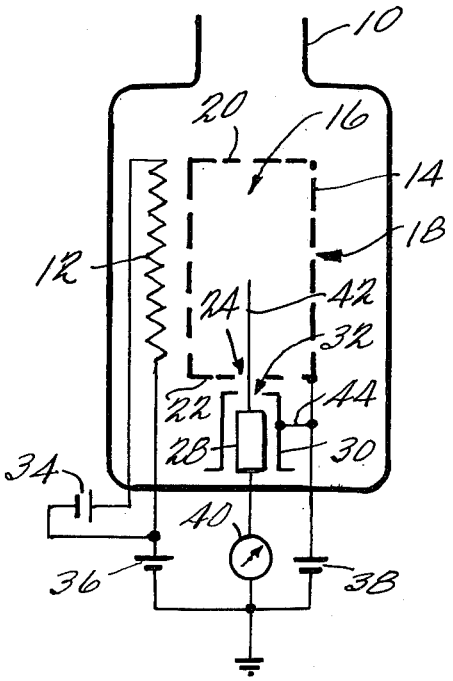
FIG. 2 is a schematic diagram of a preferred exemplary embodiment of a gauge in accordance with the present invention.

A preferred exemplary embodiment which takes advantage of the principles recognized by the present invention is shown in FIG. 2. The collector 42 is shorter than the prior art ion collector 26 and is of a relatively small diameter, for example approximately 0.002 inches or less. The opening 24 is of a relatively smaller diameter as well, for example approximately 0.15 inches. The collector shield 30 is connected to the grid 14 through the internal electrical connection 44 rather than to ground as shown in FIG. 1 or left floating (not shown). Of course, suitable means may be provided to allow for external connection of the collector shield 30 to grid 14. The collector shield 30 is suitably spaced axially from the end cap portion 22. In the preferred embodiment the end cap-collector shield spacing is less than 0.06 inches.

The improved vacuum gauge of the present invention operates as follows. Electrons from the cathode 12 are accelerated into the grid volume 16 by the positive potential of grid 14. Positive ions formed by electron impact in the grid volume 16 have insufficient energy to escape trhough openings 18 in grid 14. It is energetically possible, however, for the positive ions to escape through the opening 24 in the grid 14 through which the shortened, very thin collector 42 protrudes. The ions not collected by collector 42 escape through the opening 24 to be collected by collector support 28. Escaping ions do not have sufficient energy to impinge collector shield 30, which is held at grid potential due to the internal electrical connection 44 between grid 14 and collector shield 30.

As a result of the improved structure of the present invention, escaping ions are collected on the collector 42 or on the large collector support 28. The resulting ion current is measured by the ion current meter 40. The collector 42 is made of a very small diameter wire to reduce the amount of X-ray flux intercepted by the exposed collector structure. The collector 42 is very short to avoid the need for extensive supporting structures and to provide a suitable axially downward accelerating field. Maintaining the collector shield 30 at grid potential reduces the number of ions incident thereon, thereby maximizing the number of ions available for collection by collector 42 and collector support 28. Thus, reduced length and diameter are achieved in the present invention without sacrificing gauge sensitivity or requiring an abnormally high collector voltage.

Figure 3:
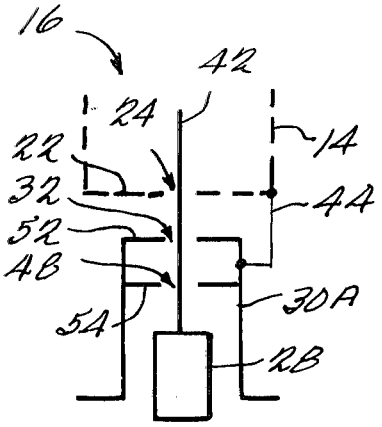
FIG. 3 is a schematic diagram showing a preferred exemplary collector shield suitable for use in the preferred exemplary embodiment.

The collector shield 30A shown in FIG. 3 contains an additional structure to reduce the adverse influence of the soft X-rays. The collector shield 30A is preferably a cap-like device having an end portion 52. The shortened ion collector 42 passes through the opening 32, as aforementioned. Within the ion collector shield 30A, however, an interior partition-like structure 54 is provided.

Structure 54 has an opening 48 through which the shortened collector 42 passes. The structure 54 forms an additional shield which prevents soft X-rays formed at the grid 14, at the edge of the opening 24, or on the inner surface of the ion collector shield 30A within end portion 52 and structure 54 from reaching the collector support 28. The radius of and the axial spacing between the openings 32 and 48 are chosen so as to optically shield the collector support 28 from most of the portions of grid 14 where soft X-rays are formed.

Figure 4:
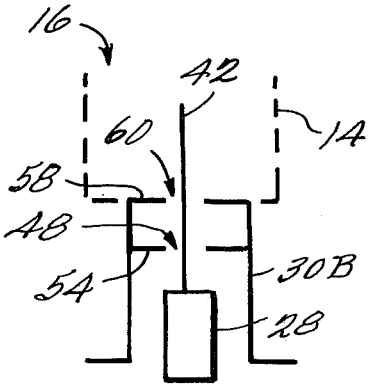
FIG. 4 is a schematic diagram of a second exemplary collector shield suitable for use in the preferred exemplary embodiment.

It will be understood that the above description is of illustrative embodiments of the present invention, and that the invention is not limited to the specific forms shown. Modifications may be made in the design and arrangement of the elements without departing from the spirit of the invention as expressed in the appended claims. For example, a different collector shield 30B, as shown in FIG. 4, may be provided having the structure 54 and the opening 48 which function as described in context with FIG. 3. In FIG. 4, however, the grid end cap portion 22 and end portion 52 of FIG. 3 are combined to form a single structure 58 which functions both as the end cap portion of the grid 14 and the end portion of the collector shield 30B. The openings 24 and 32 thereby become a single opening 60 through which the collector 42 protrudes into the grid volume 16. The radius of openings 60 and 48, and the axial spacing between the openings 60 and 48 are chosen so as to optically shield the collector support 28 from most of the grid portions where the soft X-rays are formed.

What is claimed is:

1. An ionization vacuum gauge for measurement of ultra-high vacuum comprising:

a supporting structure;

a thermionic cathode rigidly connected to said supporting structure;

a generally cylindrical grid-like anode enclosing a volume therein, said anode being rigidly connected to said supporting structure and disposed in electrical proximity to said cathode, said cathode being disposed external to said volume;

a collector support rigidly connected to said supporting structure and disposed external to said volume;

a collector extending from said collector support and protruding partially into said volume coaxially with said anode; and a shielding structure rigidly connected to said supporting structure and disposed external to said volume, between said collector support and said anode; said shielding structure having a cap-like shape for enclosing at least a portion of said collector support, and further being maintained at substantially the same potential as said anode; said collector being disposed within a first opening in an end portion of said shielding structure.

2. A gauge as in claim 1, wherein said shielding structure includes at least two chambers, one of said chambers enclosing at least a portion of said collector support and at least one other chamber enclosing a portion of said collector, adjacent chambers being divided from one another by a shielding wall having an opening therein, wherein said collector is disposed.

3. A gauge as in claim 2, wherein said anode further comprises end portions closing the respective ends of said cylindrical anode, said collector being disposed within a second opening in one of the end portions of said anode, thereby protruding into said volume.

4. A gauge as in claim 3 wherein the end portion of said shielding structure having said first opening and the end portion of said anode having said second opening are combined, said first and second openings being coextensive with one another.

5. A gauge as in claims 1 or 3 wherein the end portion of said shielding structure is axially spaced less than 0.06 inches from said anode.

6. A gauge as in claim 1 wherein said anode and said shielding structure are internally coupled to one another.

7. A gauge as in claim 1 wherein said collector is a very thin wire.

8. A gauge as in claim 7 wherein said very thin wire has a diameter less than approximately 0.002 inches.

9. A gauge as in claim 8 wherein said second opening has a diameter less than approximately 0.15 inches.

10. In an ionization gauge having a cathode for providing electrons and a grid for accelerating said electrons through a volume defined therein for ionizing a gas within said grid volume, the improvement comprising:

an ion collector having a first part of relatively reduced area for protruding into said grid volume in a coaxial disposition relative to said grid; and a second part external to said grid volume for supporting said first part;

means for shielding said second collector part from X-ray reflux produced at said grid; and means for maintaining said shielding means at a suitable potential relative to said grid;

whereby positive ions are extracted from said volume and collected by said first and second collector parts.

11. A gauge as in claim 10 wherein said first collector part is a very thin wire for providing said relatively reduced area.

12. A gauge as in claim 11 wherein a diameter of said first collector part is less than approximately 0.002 inches.

13. A gauge as in claims 10 or 11 wherein the protrusion of said ion collector into said grid volume is partial.

14. A gauge as in claim 10 wherein said shielding means is internally connected to said grid.

15. A gauge as in claim 10 wherein said shielding means is axially spaced a predetermined distance from said grid.

16. A gauge as in claim 10 further comprising at least one means for additionally shielding said second part; said additionally shielding means being disposed within said shielding means for reducing the incidence on said second part of X-ray flux produced at said grid and at an inner portion of said shielding means within an end portion thereof and said additional shielding means.

17. A gauge as in claim 16 wherein said grid comprises a cylindrical structure having planar end portions, one of said end portions of said grid and the end portion of said shielding means being combined with one another and having a common opening through which said first collector part protrudes into said grid volume.

* * * * *

UNITED STATES PATENT AND TRADEMARK OFFICE

CERTIFICATE OF CORRECTION

PATENT NO. : 4,307,323

DATED : December 22, 1981

INVENTOR(S) : Bills et al

It is certified that error appears in the above—identified patent and that said Letters Patent is hereby corrected as shown below:

Col. 1, line 10: "election" should be --electron--

Col. 1, line 39: "close" should be --closed--

Col. 4, line 36: "trhough" should be --through--

Col. 6, line 32: "reflux" should be --flux--

Signed and Sealed this

*First* Day of *June 1982*

[SEAL]

*Attest:*

GERALD J. MOSSINGHOFF

*Attesting Officer*

*Commissioner of Patents and Trademarks*